US012453384B2

(12) United States Patent
Carlson

(10) Patent No.: US 12,453,384 B2
(45) Date of Patent: Oct. 28, 2025

(54) INTERCHANGEABLE GARMENT ADJUSTMENT SYSTEM

(71) Applicant: Ashley J. Carlson, Kalispell, MT (US)

(72) Inventor: Ashley J. Carlson, Kalispell, MT (US)

( * ) Notice: Subject to any disclaimer, the term of this patent is extended or adjusted under 35 U.S.C. 154(b) by 103 days.

(21) Appl. No.: 17/375,633

(22) Filed: Jul. 14, 2021

(65) Prior Publication Data

US 2023/0016986 A1 Jan. 19, 2023

(51) Int. Cl.
*A41C 1/12* (2006.01)
*A41C 1/08* (2006.01)
*A41F 1/04* (2006.01)

(52) U.S. Cl.
CPC ..... *A41C 1/12* (2013.01); *A41C 1/08* (2013.01); *A41F 1/04* (2013.01); *Y10T 24/3742* (2015.01)

(58) Field of Classification Search
CPC ..... A41C 1/12; A41C 1/08; A41F 1/04; Y10T 24/3742
See application file for complete search history.

(56) References Cited

U.S. PATENT DOCUMENTS 759,072 A * 5/1904 Brooks ..... A41F 1/04 24/713.6
1,137,540 A * 4/1915 Schweinburg ..... A41F 1/04 450/129
1,560,545 A * 11/1925 Cunningham ..... A43C 1/04 450/136
1,902,895 A * 3/1933 Smith ..... A41F 9/025 2/221
1,983,810 A * 12/1934 Rice ..... A41F 1/04 24/713.9
2,080,240 A * 5/1937 Usher ..... A41F 1/04 24/714.4
2,139,305 A * 12/1938 Friend ..... A41C 1/00 450/114
2,410,083 A * 10/1946 Kispert ..... A41F 1/04 450/142
2,464,452 A * 3/1949 Kispert ..... A41C 1/08 450/129
3,127,617 A 4/1964 Bonzi
8,418,267 B2 4/2013 Shaw et al.
10,287,721 B1 5/2019 Rizzo
2006/0277660 A1* 12/2006 MacMillan ..... A41D 27/00 2/232
2010/0043125 A1 2/2010 MacLean
2010/0293700 A1 11/2010 Gillespie et al.
2011/0307420 A1* 12/2011 Shaw ..... A41D 27/08 2/244
2012/0047630 A1 3/2012 Gare
2012/0266364 A1* 10/2012 Dyon ..... A41B 7/02 2/244

(Continued)

*Primary Examiner* — Khoa D Huynh
*Assistant Examiner* — Erick I Lopez
(74) *Attorney, Agent, or Firm* — Dorsey & Whitney LLP

(57) ABSTRACT

A garment adjustment system includes a first connective element removably fastened to a garment by at least a first fastener affixed to the garment in a first location. A second connective element is removably fastened to the garment by at least a second fastener affixed to the garment in a second location. A linking component is linked to the first connective element and the second connective element such that adjustment of the linking component changes a distance between the first location and the second location of the garment.

11 Claims, 8 Drawing Sheets

(56) References Cited

U.S. PATENT DOCUMENTS

| | | | | |
|---|---|---|---|---|
| 2014/0331380 | A1 | 11/2014 | Brown et al. | |
| 2017/0006969 | A1* | 1/2017 | Wang | A41F 1/04 |
| 2018/0213869 | A1 | 8/2018 | Andrews | |

* cited by examiner

INTERCHANGEABLE GARMENT ADJUSTMENT SYSTEM

BACKGROUND

Adjusting sizing of standard sized garments may improve comfort and performance for individual wearers. Permanently re-sizing a garment (e.g., by creating new seams or adjusting existing seams) may be difficult, expensive, and may not allow for a range of adjustments for fluctuations in body size. Many options, such as magnetic fasteners or temporary adhesives, for temporary re-sizing may move with heavy activity, causing the need for ongoing adjustments. Further, many available temporary resizing solutions add metallic components to garments and are therefore impractical for wearers in certain settings (e.g., medical settings).

SUMMARY

A garment adjustment system includes a first connective element removably fastened to a garment by at least a first fastener affixed to the garment in a first location. A second connective element is removably fastened to the garment by at least a second fastener affixed to the garment in a second location. A linking component is linked to the first connective element and the second connective element such that adjustment of the linking component changes a distance between the first location and the second location of the garment.

An example garment adjustment system includes a first plurality of fasteners configured to attach to a garment in a first location and a second plurality of fasteners configured to attach to the garment in a second location. A flexible first connective element comprises a first plurality of fastening features. The first plurality of fastening features are configured to couple with the first plurality of fasteners to removably connect the first connective element to the garment in the first location. A flexible second connective element comprises a second plurality of fastening features. The second plurality of fastening features are configured to couple with the second plurality of fasteners to removably connect the second connective element to the garment in the second location. A linking component is configured to movably couple to a first plurality of linking features of the first connective element and a second plurality of linking features of the second connective element. The linking component is configured to move with respect to the first plurality of linking features and the second plurality of linking features to change a distance between the first connective element and the second connective element.

An example garment adjustment system may include a sleeve adjuster comprising a first fastening feature and a second fastening feature, where the first fastening feature is configured to couple with an inner sleeve fastener on an inner surface of a sleeve of a garment, where the second fastening feature is configured to couple with an outer sleeve fastener on an outer surface of the sleeve of the garment. A pocket cover comprises a first fastening feature and a second fastening feature, where the first fastening feature is configured to couple with an inner fastener on an inner surface of a pocket of the garment, where the second fastening feature is configured to couple with an outer fastener on an outer surface of the pocket of the garment.

Additional embodiments and features are set forth in part in the description that follows, and will become apparent to those skilled in the art upon examination of the specification and may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

DETAILED DESCRIPTION

Figure 1:
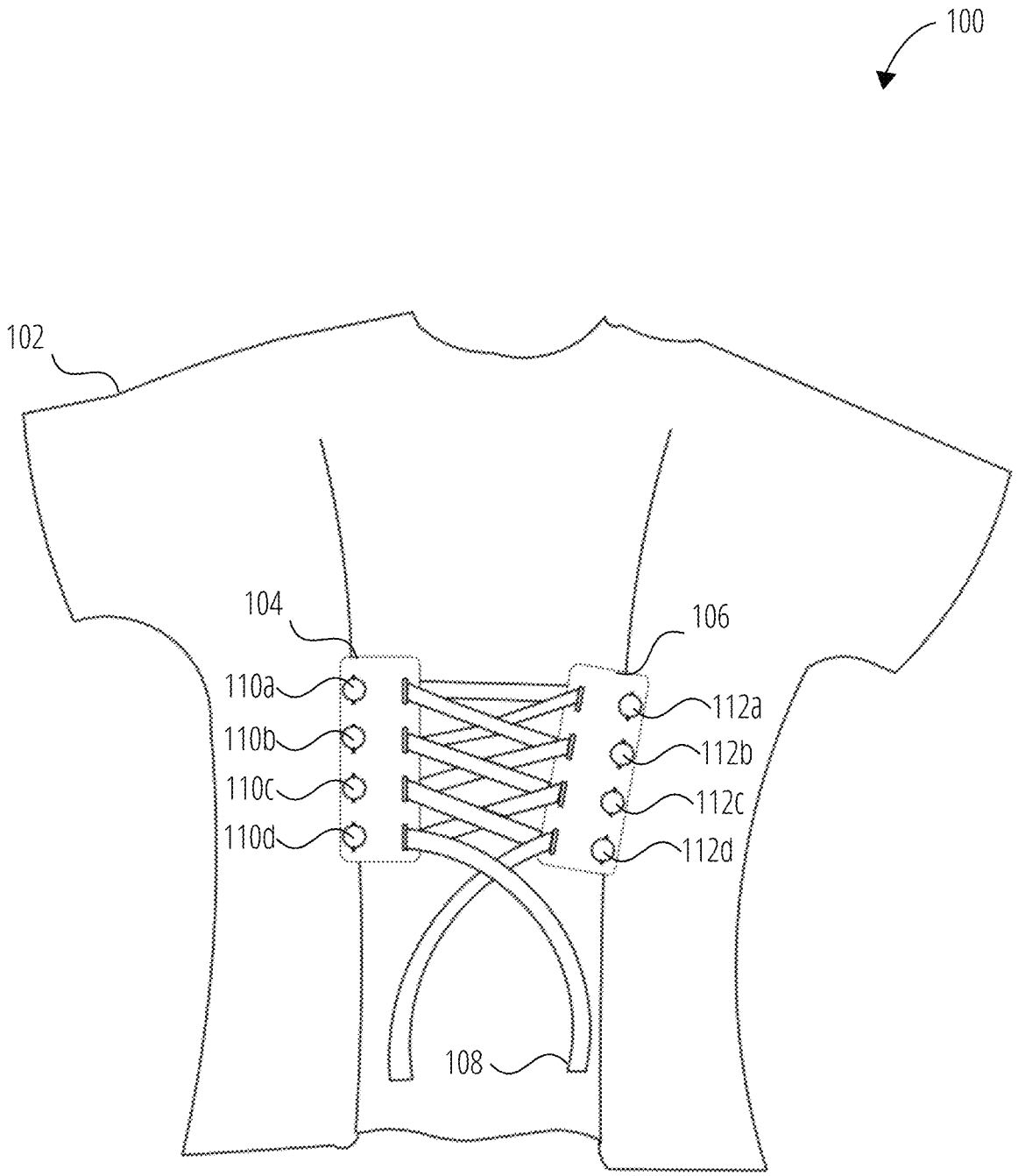
FIG. 1 illustrates an interchangeable garment adjustment system adjusting the fit of a garment.

An interchangeable garment adjustment includes connective elements including fastening features and linking features. The fastening features may couple with fasteners affixed to the garment to removably attach the connective elements to the garment. A linking component movably couples with the linking features such that when the linking component is adjusted (e.g., tightened or loosened), a distance between the connective elements changes, adjusting the garment due to the attachments between the connective elements and the garment.

In an example implementation, fabric connective elements include fastening apertures and linking apertures as the fastening features and linking features, respectively. The fastening features may be buttons sewn onto the garment that, when pushed through the fastening apertures, removably attach the connective elements to the garment. The linking component may be a cord, string, ribbon, or other flexible connector that interlaces through the linking apertures of both connective elements. Accordingly, tightening the linking component (e.g., shortening the length of the linking component between the connective elements), the garment adjusts to fit tighter as the connective elements pull the buttons affixed to the garment closer together, pulling the garment closer together. As the linking component may be continually adjusted, fit of the garment may be customized to the wearer. For example, the distance between the connective elements may be a variety of distances not limited by discrete intervals or pre-determined increments of distance. Accordingly, fit of the garment may be adjusted to the comfort and size of the user.

In various implementations, the linking component may be tied off (e.g., in a bow) when the garment is adjusted to the desired fit for the user. The tie may be sturdy enough to remain tied during wear, while also allowing the ends of the linking component to be untied for removal of the garment. The buttons also generally hold the connective elements in place, such that the connective elements and the linking component are unlikely to become unsecured during wear. Accordingly, the garment is more likely to remain adjusted to a comfortable fit for the wearer throughout the day. Further, various implementations of the interchangeable garment adjustment may be constructed using non-metal components, such that the adjustment system may be used, for example, by medical personnel who require non-metal garments. Further, fabric or other flexible connective elements may allow the garment adjustment to move with the wearer and movement of the garment, leading to increased comfort during wear, especially with heavy movement.

The interchangeable garment adjustment system may also serve various aesthetic purposes. For example, adjustment of a standardized garment may improve fit and overall aesthetics of the garment. Many garments, such as medical scrubs, may be constructed to fit a wide variety of body types and, accordingly, may be unflattering to some wearers without adjustment. Further, in various implementations, the connective elements may form decorative elements to enhance or complement the garment. For example, the connective elements may be constructed from patterned fabric, allowing the wearer to customize a standardized garment. In some implementations, the connective elements may be constructed from two different patterned fabrics and may be reversible, such that a wearer may achieve two different looks with one set of connective elements. The connective elements may also be shaped to provide a decorative element to the garment. The connective elements, fasteners, and linking component may vary from the examples described above, as described herein and shown in the accompanying figures.

Turning now to the figures, with reference to FIG. 1, the garment adjustment system 100 may be used for adjustment of various types of garments. The garment 102 shown in FIG. 1 is a shirt, which may be, for example, a medical scrub shirt, a t-shirt, or any other type of top. The garment adjustment system 100 may further be used with, for example, sweatshirts, jackets, dresses, pants, skirts, coats, jumpsuits, or other wearable items. Generally, the garment adjustment system 100 may be advantageously used for standardized garments, such as, for example, uniform pieces coming in a limited number of sizes. Accordingly, the garment adjustment system 100 may improve uniform fit by providing additional sizing options. Further, uniform components (e.g., scrub tops) may be reused or shared by multiple wearers who are each able to customize fit without permanently altering fit of the garment for other users.

Figure 2:
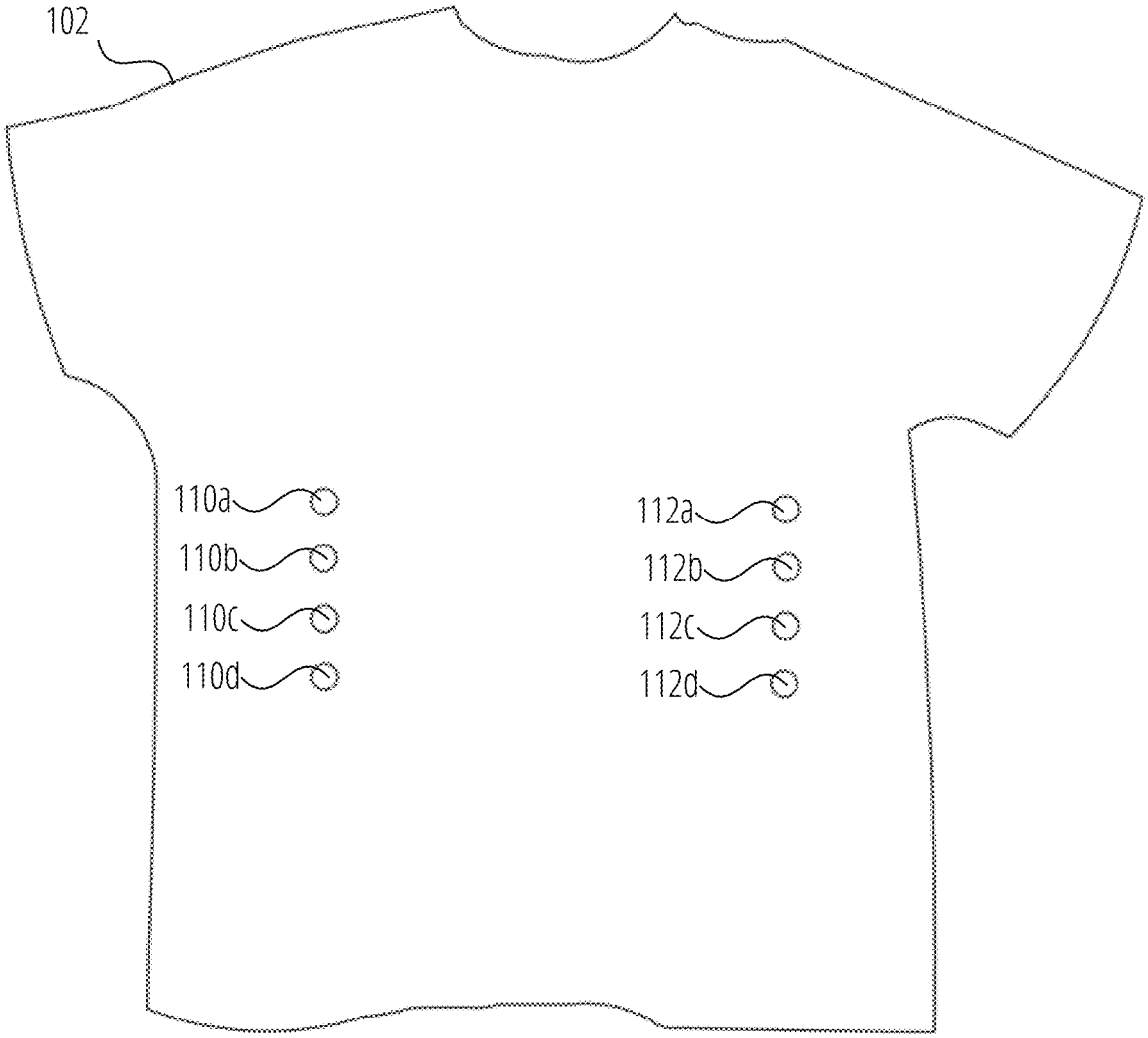
FIG. 2 illustrates a garment including fasteners.

With reference to FIG. 2, a garment 102 may include fasteners 110*a-d* and 112*a-d*. Generally, the garment 102 includes at least a first fastener and a second fastener, where the first fastener may be affixed to the garment 102 and a first location and the second fastener may be affixed to the garment 102 in a second location. The first and second locations may be for example, a point on the garment or, as shown in FIG. 2, the first location may be a line formed by fasteners 110*a-d* and the second location may be a line formed by fasteners 112*a-d*. Generally, the first location and the second location are chosen to adjust the garment 102 in some specific way. For example, the location of the fasteners 110*a-d* the location of fasteners 112*a-d* are chosen such that when a distance between the locations changes, the garment 102 is either brought in or let out at the waist. In other implementations, locations may be chosen to, for example, adjust the length of a garment (e.g., sleeves, pant legs, etc.), adjust the measurements of a waistband, or to make other adjustments to the garment. In various implementations, different numbers of fasteners may be used to provide, for example, a different aesthetic to the garment 102 or a more secure or robust fit provided by the garment adjustment system 100. For example, in one implementation one fastener may be affixed to the garment 102 at the first location and another fastener may be affixed to the garment 102 at the second location, providing some adjustment to the garment 102 with a looser fit overall. In other implementations, additional fasteners may be added at the first location and the second location to provide a more form fitting shape for the garment 102.

Fasteners 110*a-d* and fasteners 112*a-d* may be, as shown in FIG. 2, round buttons. In one embodiment, the fasteners 110*a-d* and 112*a-d* are non-metallic buttons (e.g., plastic buttons, wood buttons, bamboo buttons) such that the garment adjustment system 100 may be used in working environments, such as medical environments, where metallic components are undesirable. In some implementations, fasteners may be buttons with shapes other than circular. For example, shaped buttons such as hearts, stars, or other shapes may add a decorative element to the garment adjustment system 100.

Figure 4A:
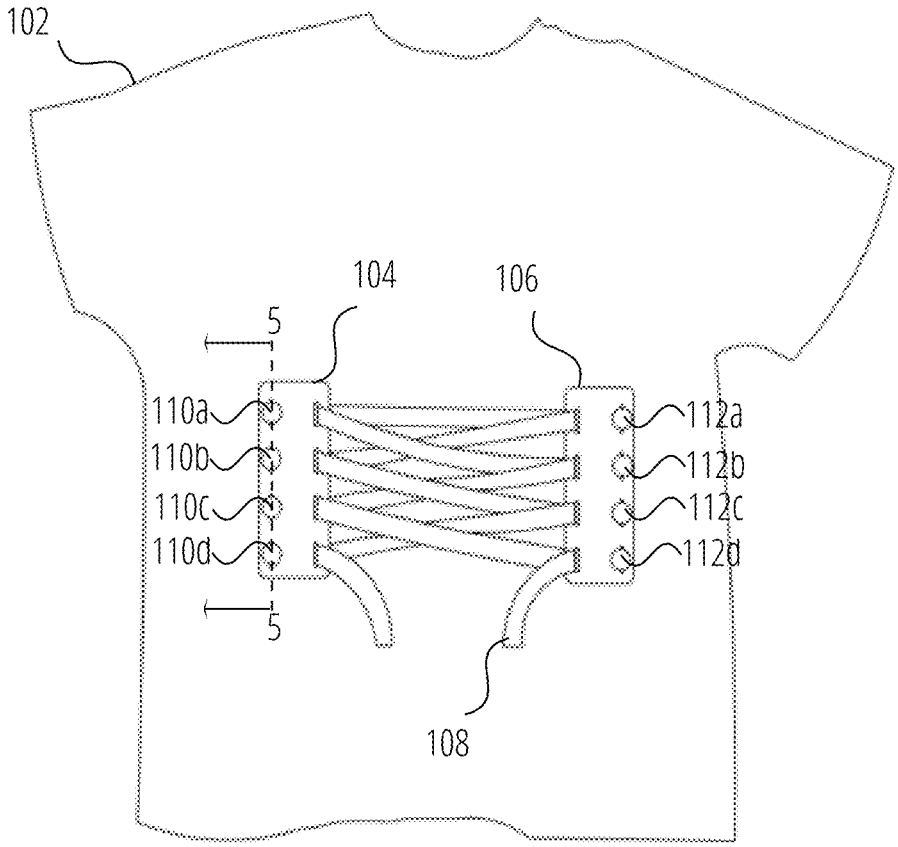
FIG. 4A illustrates an interchangeable garment adjustment system.
Figure 4B:
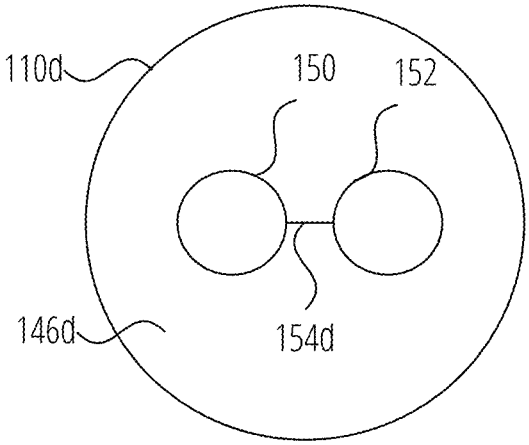
FIG. 4B illustrates a fastener of an interchangeable garment adjustment system.
Figure 5:
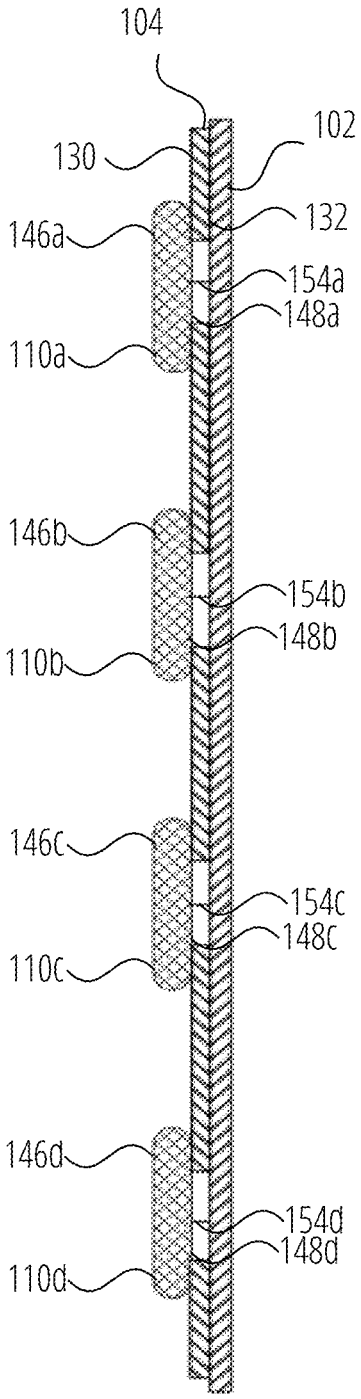
FIG. 5 illustrates a section view of an interchangeable garment adjustment system, taken along line 5-5 of FIG. 4A.

With reference to FIG. 4B and FIG. 5, where the fasteners are buttons, each fastener may generally include an outer surface, an inner surface, and some feature providing a way to attach the fastener to the garment 102. For example, FIG. 4B is a view of fastener 110*d* showing the outer surface 146*d* of the fastener 110*d*. As shown in FIG. 5, a section view of the fastener 110*d*, an inner surface 148*d* of the fastener 110*d* may generally oppose the outer surface 146*d* of the fastener 110*d*. Returning to FIG. 4B, the fastener 110*d* includes an aperture 150 and an aperture 152 extending through a thickness of the fastener 110*d* from the outer surface 146*d* to the inner surface 148*d*. The apertures 152 and 150 may provide a means for attaching the fastener 110*d* to the garment 102. For example, a thread 154*d* may extend through both apertures 152 and 150, over the outer surface 146*d*, and through fabric of the garment 102 to secure the fastener 110*d* to the garment 102. Various implementations of fasteners may include additional apertures extending through the fasteners or different orientations of apertures relative to the surfaces of the fasteners. For example, some fasteners may include four apertures extending through the fastener, where thread extends over the outer surface of the aperture in an "x" pattern to secure the fastener to the garment 102. Other fasteners may not include apertures extending from the outer surface to the inner surface and may instead include a loop, ring, or other structure extending from the inner surface of the fastener which may receive thread to connect the fastener to the garment 102. Though the apertures 152 and 150 are described with respect to the fastener 110*d*, each of the fasteners 110*a*-110*d* and fasteners 112*a*-112*d* may include similar features.

Figure 7:
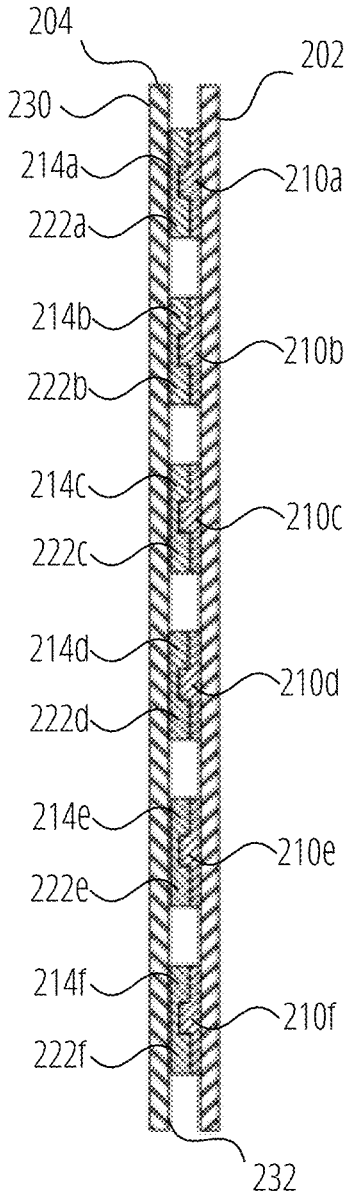
FIG. 7 illustrates a section view of an interchangeable garment adjustment system, taken along line 7-7 of FIG. 6.

Other types of fasteners are also contemplated. For example, FIG. 7 shows fasteners 210*a-f* on the garment 202 which are half of a snap such that fastening features 214*a-f* interface with the fasteners 210*a-f* to secure the connective element 204 to the garment 202. Such snaps may be plastic, non-magnetic metal (e.g., non-ferrous metals), or other suitable materials. Snaps may be sewn, pressed, or otherwise attached to the garment 202. Further, snaps or other types of fasteners may be placed between the connective elements 204 and 206 and the garment 202, creating a different aesthetic look for the garment 202. Other types of fasteners may also be used with the garment adjustment system 100 or the garment adjustment system 200, when paired with corresponding fastening features of the connective elements. For example, fasteners may be half of a loop and hook closure (with the fastening feature comprising the corresponding other half of the hook and loop closure), a hook or an eye of a hook and eye closure (with the fastening feature comprising the corresponding other half of the hook and eye closure), or other type of fastener that may removably connect connective elements to the garment.

Turning now to FIG. 1, the garment adjustment system 100 includes a connective element 104 and a connective element 106. The connective elements include fastening features such that the connective elements may be removably fastened to the garment 102. In various implementations, the connective elements may be various shapes, sizes, and materials, depending on desired aesthetics and functionality of the garment adjustment system 100. For example, in one implementation, the connective elements 104 and 106 may be constructed of two or more layers of fabric, providing a more robust construction than a single layer of fabric. Further, in some implementations, each layer of fabric may include a different decorative pattern, such that the connective elements may be reversed to provide a different overall look for the garment 102. In other implementations, connective elements may be constructed from a single layer of durable fabric, such as canvas, which may include surface treatments for water resistance, stain resistance, etc. Connective elements may also be constructed from various flexible plastics, natural or synthetic fibers, or other suitable materials.

Figure 3:
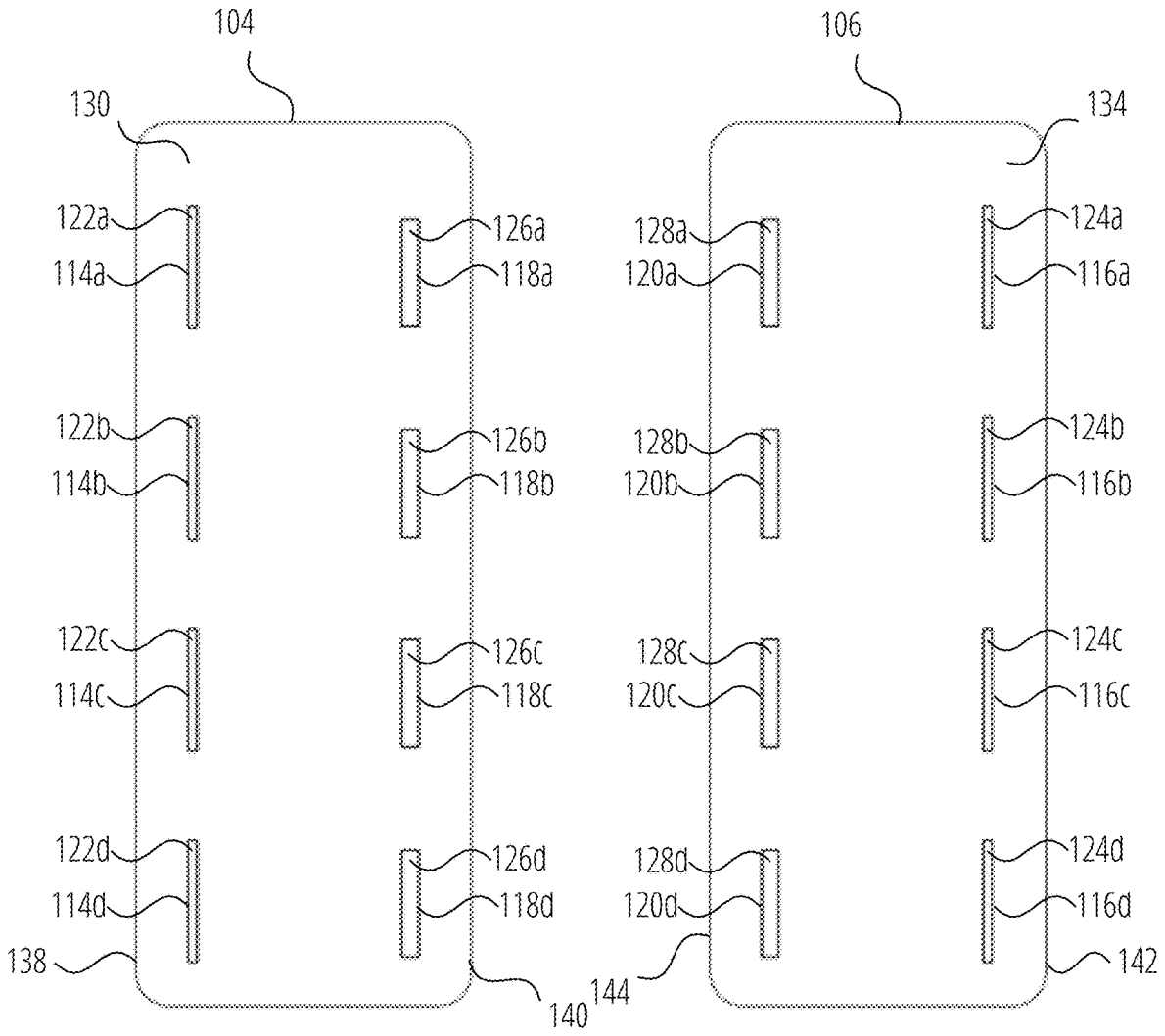
FIG. 3 illustrates connective elements of an interchangeable garment adjustment system.

As shown in FIG. 3, in some implementations, the connective element 104 and the connective element 106 may be substantially rectangular in shape. Other shapes of connective elements, such as, for example, circular, oval, square, or other shapes are possible. In some implementations, the connective elements may be shaped such that the connective elements form a decorative element (e.g., heart shaped, star shaped, etc.). With reference to FIG. 5, the connective element 104 has a first surface 130 and a second surface 132 opposing the first surface 130. As described above, the first surface 130 and the second surface 132 may be opposing surfaces of one piece of material or may be two different pieces of material joined, for example, at the perimeter of the connective element 104 by stitching, adhesive, or other joining method.

Returning to FIG. 3, the connective element 104 is bounded by an inner edge 140 and an outer edge 138, with the first surface 130 of the connective element 104 extending between the outer edge 138 and the inner edge 140. The connective element 104 also includes a plurality of fastening features 114*a-d* each located between a central axis (e.g., the midline between the inner edge 140 and the outer edge 138) and the outer edge 138. The fastening features 114*a-d* may be, as shown in FIG. 3, equidistant from the outer edge 138 and spaced along a length of the connective element 104. In other implementations, fastening features may be located at varying distances from the outer edge 138 and may be distributed irregularly along the length of the connective element. Further, while the connective element 104 is shown with four fastening features 114*a-d*, other implementations of connective elements may include other numbers of fastening features. For example, some connective elements may include one fastening feature and some connective elements may include five, six, or more fastening features. The connective element 106 also shown in FIG. 3 is bounded by an outer edge 142 and an inner edge 144 with fastening features 116*a-d* located similarly with respect to the connective element 106 as the fastening features 114*a-d* with respect to the connective element 104.

The fastening features 114*a-d* are shown as fastening apertures 122*a-d*, extending through the connective element 104 from the first surface 130 to the second surface 132. The fastening apertures 122*a-d* may be shaped as slits, elongated rectangles, or other suitable shapes depending on the specifications of the fasteners (e.g., fasteners 110*a-d*) used with the garment adjustment system 100. In some implementations, edges of the fastening apertures 122*a-d* may be finished or protected (e.g., using a finishing seam, trim, adhesive, or other finishing element) to reduce possible tearing, stretching, or deformation of the fastening apertures during wear of the garment 102. The fastening apertures 124*a-d* formed in connective element 106 may have the same or similar characteristics as those formed in the connective element 104.

With reference to FIG. 7, fastening features may, in some implementations, be other structures affixed to or formed as part of connective elements. For example, the connective element 204 includes fastening features 214*a-f*. Instead of fastening apertures, the fastening features 214*a-f* are fastening components 222*a-f* configured to interface with fasteners 210*a-f*. The fastening components 222*a-f* may be a receiving structure for a snap of the fasteners 210*a-f*. In other implementations, fastening components 222*a-f* may be different types of structures compatible with different fasteners. For example, fastening components may be, in various implementations, half of a loop and hook closure (with the fastener comprising the corresponding other half of the hook and loop closure), a hook or an eye of a hook and eye closure (with the fastener comprising the corresponding other half of the hook and eye closure), or other type of fastening component configured to interface with a fastener that may removably connect connective elements to the garment. As further shown in FIG. 7, the fastening components 222*a-f* may be affixed to a second surface 232 of the connective element 204 such that a first surface 230 of the connective element 204 forms a continuous surface and the fastening components 222*a-f* are hidden from the exterior of the garment adjustment system 200 (as shown, for example, in FIG. 6). Though not shown, the connective element 206 may include similar fastening features as those described with respect to the connective element 204.

Returning to FIG. 3, connective elements 104 and 106 include linking features 118*a-d* and linking features 120*a-d*, respectively. For example, the connective element 104 includes a plurality of linking features 118*a-d* located between the central axis and the inner edge 140. The linking features 118*a-d* may be, as shown in FIG. 3, equidistant from the inner edge 140 and spaced along a height of the connective element. Further, while the connective element 104 is shown with four linking features 118*a-d*, other implementations of connective elements may include other numbers of linking features. For example, some connective elements may include five, six, or more linking features. The connective element 106 also shown in FIG. 3 includes linking features 120*a-d* located similarly with respect to the connective element 106 as the linking features 118*a-d* with respect to the connective element 104.

The linking features 118*a-d* are shown as linking apertures 126*a-d*, extending through the connective element 104 from the first surface 130 to the second surface 132. The linking apertures 126*a-d* may be shaped as slits, elongated rectangles, circles, or other suitable shapes. In some implementations, edges of the linking apertures 126*a-d* may be finished or protected (e.g., using a finishing seam, trim, adhesive, eye, grommets, or other finishing element) to reduce possible tearing, stretching, or deformation of the linking apertures 126*a-d* during wear of the garment 102. The linking apertures 128*a-d* formed in the connective element 106 may have the same or similar characteristics as those formed in the connective element 104.

Figure 6:
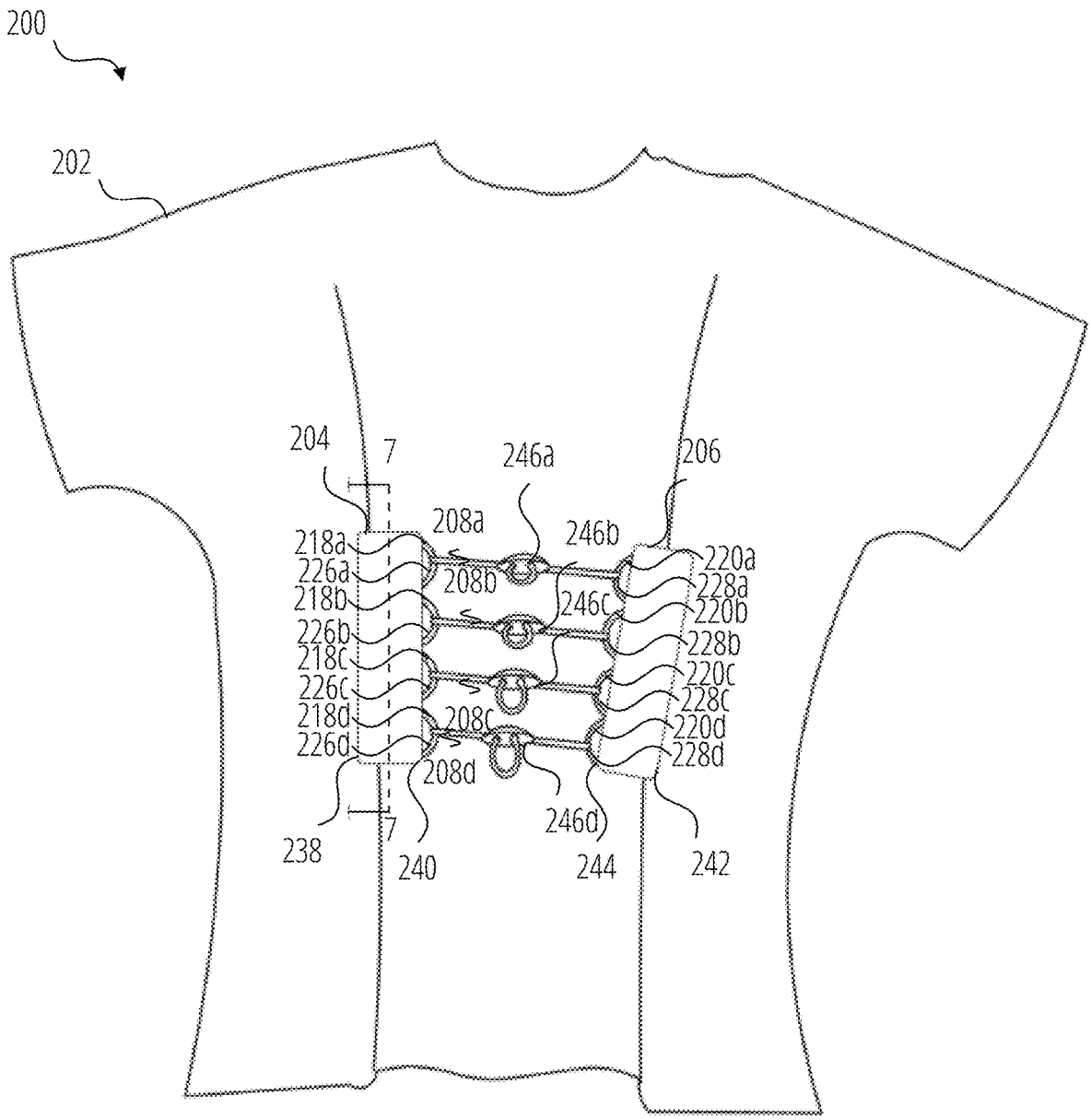
FIG. 6 illustrates an interchangeable garment adjustment system adjusting the fit of a garment.

With reference to FIG. 6, linking features may, in some implementations, be other structures affixed to or formed as part of connective elements. For example, linking features 218*a-d* of the connective element 204 are formed as linking loops 226*a-d*. As shown in FIG. 6, the linking loops 226*a-d* may each be affixed to the inner edge 240 of the connective element 204 at two ends to form a loop structure extending out from the connective element 204. The linking loops 226*a-d* may be formed by flexible members such as cords, elastic, fabric, etc. In some implementations, linking loops 226*a-d* may be constructed from rigid materials. For example, plastic rings may be sewed or otherwise affixed to the connective elements. The linking loops 228*a-d* of the connective element 206 may be implemented using any of the implementations described with respect to the linking loops 226*a-d*.

Other types of linking features may be used, in various implementations. For example, a linking feature may be implemented by a direct attachment between a linking component and a connective element. For example, linking components may be implemented by elastic features sewn onto the connective elements, where the linking features are formed by the connection. Other linking features connecting linking components to the connective element may include, for example, zippers, snaps, hook and eye closures, etc.

With reference to FIG. 1, the garment adjustment system 100 includes a linking component 108 connecting the connective element 104 to the connective element 106. The linking component 108 is generally adjustable in some manner to adjust the distance between the connective element 104 and the connective element 106 and, ultimately, the fit of the garment 102. For example, the linking component 108 shown in FIG. 1 is an elongated flexible member which may be, for example, a ribbon, fabric lacing, a braided cord, or other suitable flexible member. The linking component 108 shown in FIG. 1 is substantially planar and rectangular shaped, such that the linking component 108 fits within the linking features of the connective element 104 and connective element 106. In other implementations, a linking component may have, for example, a circular cross-section where the linking features are circular. The linking component 108 generally has a length sufficient to interlace between the connective element 104 and the connective element 106 as shown in FIG. 1, with additional ends that may be, for example, tied off to secure the linking component 108. In some implementations, an additional securing feature, such as a tie, clamp, or other component may be placed on the linking component 108 to secure the ends of the linking component 108.

While the linking component 108 in FIG. 1 is shown as a single elongated member, in other implementations, a linking component may include a plurality of individual members extending between corresponding linking features of the connective elements. For example, FIG. 6 includes linking components 208*a-d* extending between the connective element 204 and the connective element 206. The linking components 208*a-d* may be for example, elastic cord, braided cord, string, or other types of elongated members. Each of the linking components 208*a-d* include an adjuster (e.g., adjusters 246*a-d*) which may be used to change the distance between the connective elements and to secure the linking component once a desired distance is achieved. For example, the adjusters 246*a-d* are shown as spring adjusters, though other types of adjusters may be used. In other examples, each linking component 208*a-d* may be individually tied at a desired length instead of adding adjusters.

Returning to FIG. 1, the garment adjustment system 100 is formed by first affixing fasteners 110*a-d* and fasteners 112*a-d* to the garment 102 and first and second locations, respectively. As shown in FIG. 5, in some implementations the fasteners 110*a-d* may be affixed to the garment 102 through sewing, such that thread 154*a-d* secure fasteners 110*a-d* to the garment 102. When secured to the garment 102, the inner surfaces 148*a-d* of the fasteners 110*a-d* face towards the garment 102 and the outer surfaces 146*a-d* face outwards from the garment 102. The fasteners 112*a-d* may be affixed to the garment 102 in a similar manner. In other implementations, such as the garment adjustment system 200 shown in FIG. 6, fasteners may be affixed to the garment 202 using different techniques. For example, as shown in FIG. 7, the fasteners 210*a-f* may be directly affixed to the garment 202 through adhesive, sewing, or other means.

When the fasteners are affixed to the garment, connective elements may be attached to the garment via the fasteners. With reference to FIG. 5, in some implementations, the fasteners 110*a-d* may be pushed through the fastening apertures 122*a-d* of the connective element 104 to secure the connective element 104 to the garment 102. The fasteners 110*a-d* may have a larger diameter than at least one dimension of the fastening apertures 122*a-d* such that when the fasteners 110*a-d* are pushed through the fastening apertures 122*a-d*, at least a portion of the inner surfaces 148*a-d* of the fasteners 110*a-d* rest against the first surface 130 of the connective element 104 to secure the connective element 104 to the garment 102. When the connective element 104 is secured to the garment 102, the second surface 132 of the connective element 104 generally touches the outer surface of the garment 102. The connective element 106 may be secured to the garment 102 in a similar manner using the fasteners 112*a-d*.

With reference to FIG. 7, in another implementation, the connective element 204 may be attached to the garment 202 by securing the fastening components 222*a-f* to the fasteners 210*a-f*. For example, the fasteners 210*a-f* and the fastening components 222*a-f* may be complementary portions of a snap where, to secure the connective element 204 to the garment 202, the two portions of the snap are pushed together. In these implementations, the second surface 232 of the connective element 204 may be spaced apart from the garment 202 slightly and the fasteners and fastening components are out of view between the connective element 204 and the garment 202. The connective element 206 may be attached to the garment 202 in a similar manner. In yet another implementation, the connective element 204 and the connective element 206 may include an additional outer layer of fabric such that buttons may be used as fasteners without being visible from the exterior of the connective elements 204 and 206. Where other types of fasteners are used, the connective elements may be attached differently to the garment. For example, where a hook and loop closure is used, the attachment may be similar to the attachment between the connective element 204 and the garment 202 shown in FIG. 7.

When the connective elements are attached to the garment, the linking component may be attached to both connective elements. In some implementations, the linking component may be attached to each of the connective elements before the connective elements are attached to the garment.

Linking components are generally connected to the connective elements via the linking features of the connective elements. For example, as shown in FIG. 1, the linking component 108 is laced through each of the linking features 118*a-d* of the connective element 104 and each of the linking features 120*a-d* of the connective element 106. When connected, the linking component 108 is moveable with respect to the linking features 118*a*-d and 120*a-d* such that the linking component 108 can be pulled through the linking features 118*a-d* and 120*a-d* in either direction.

In the implementation shown in FIG. 6, the linking components 208*a-d* may be fixedly connected to linking loops 226*a-d* and 228*a-d*. Adjusters 246*a-d* may be placed on the linking components 208*a-d* such that a portion of the linking components 208*a-d* are threaded through the adjusters. In some implementations, the linking components 208*a-d* may be removably connected to the linking loops 226*a-d* and 228*a-d*. For example, linking component 208*a* may be a flexible member with a first end and a second end where each of the first and second ends are secured by the adjuster 246*a*. Accordingly, to connect the linking component 208*a* to the linking loops 226*a* and 228*a*, the first end may be threaded through the linking loop 226*a* and through a first aperture in the adjuster 246*a* and the second end may be threaded through the linking loop 228*a* and through a second aperture in the adjuster 246*a*. In various implementations, other types of removable or fixed connections between linking components and connective elements may be used.

When the garment adjustment system 100 is assembled, the linking component 108 may be adjusted to adjust the size and fit of the garment 102. For example, FIG. 4A and FIG. 1 each show the garment adjustment system 100 assembled and attached to the garment 102. In FIG. 4A, the linking component 108 is adjusted such that the distance between the connective element 104 and the connective element 106 (and accordingly, between the first location and second location on the garment 102) is unchanged from the garment 102 without the garment adjustment system 100. Such an adjustment may be useful, for example, for ease of putting on and removing the garment 102. To adjust the fit of the garment 102, the ends of the linking component 108 may be pulled down, pulling the connective element 104 and the connective element 106 (and the first and second locations on the garment 102) closer together, as shown in FIG. 1. Because the linking component 108 is infinitely adjustable with respect to the connective elements 104 and 106 (that is, there are not pre-defined adjustments), a variety of fits may be achieved and can be highly customized to the wearer. Accordingly, the garment 102 may fit more comfortably and a standard sized garment 102 can be adjusted to fit a wider variety of body shapes and sizes.

When a preferred adjustment of the linking component 108 is achieved, the ends of the linking component 108 may be tied or otherwise secured for wear of the garment 102. The fit of the garment 102 may be easily adjusted during wear or between wears by adjusting the linking component 108. Further, several different sets of connective elements can be used with a linking component to provide a changing decorative element to a garment without making permanent changes to the garment.

Figure 8:
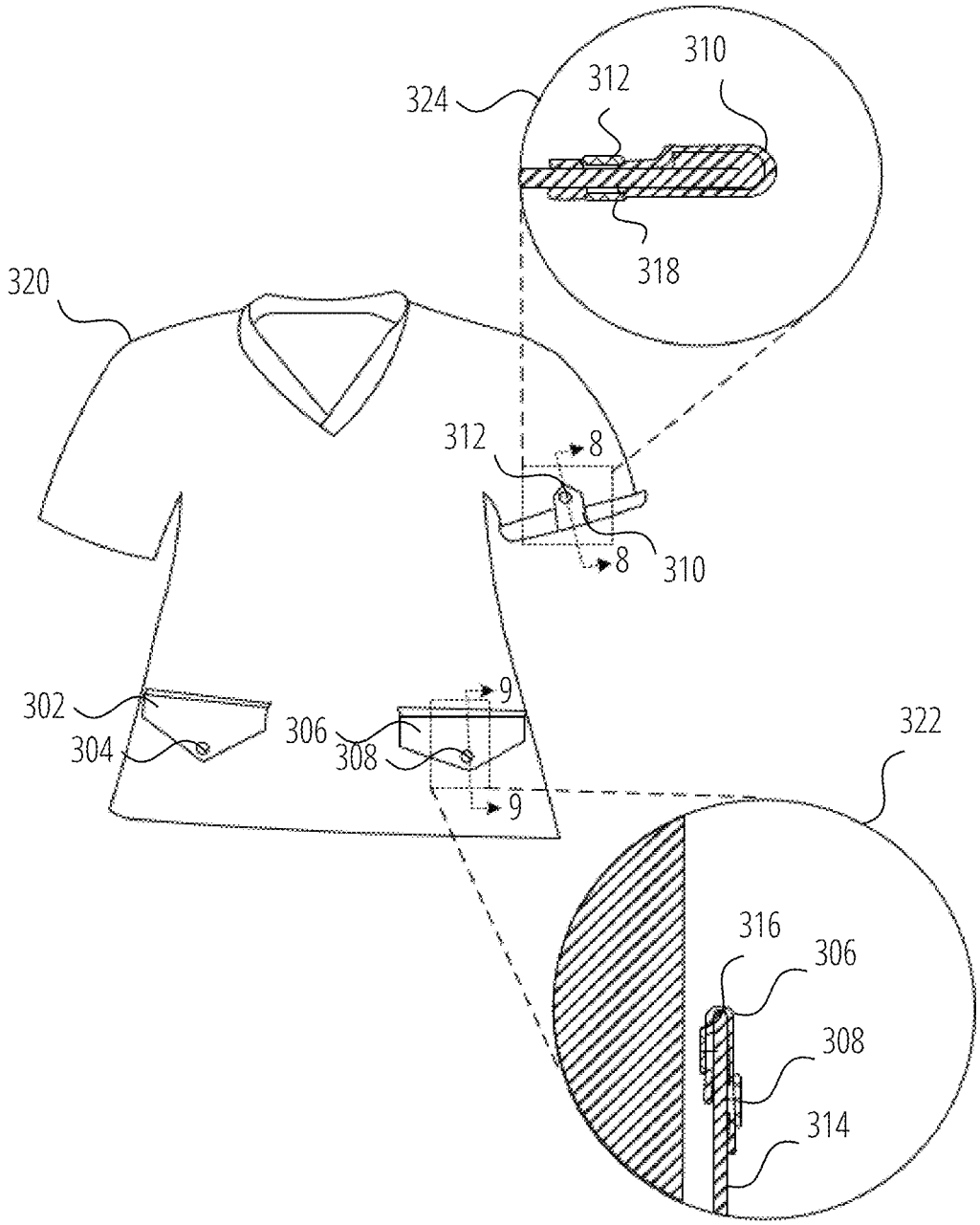
FIG. 8 illustrates additional components of an interchangeable garment adjustment system.

With reference to FIG. 8, in some implementations, additional components may be provided to allow for additional adjustments to and decorative elements for a garment 320. For example, the garment 320 includes a pocket cover 302, a pocket cover 306, and a sleeve adjuster 310. Pocket covers may provide a decorative element for any pocket on a garment. In some implementations, additional sleeve adjusters may be included and additional adjusters may be used for, for example, shortening a hem of the garment 320.

View 322 shows a section view of the pocket cover 306, taken along section line 9-9. A pocket 314 may be an additional piece of fabric sewn to the garment 320 or may be a portion of the garment 320. The pocket 314 may include a fastener 316 (e.g., an inner fastener) inside the pocket 314 and a fastener 308 outside of the pocket 314. The fastener 316 and fastener 308 may be any type of fastener, including those described with respect to the fasteners 110*a-d* and the fasteners 112*a-d*. For example, in FIG. 8, the fastener 316 and the fastener 308 are buttons sewn to the pocket 314 of the garment 320. The pocket cover 306 may be one or more layers of fabric including a fastening feature configured to couple with the inner fastener 316 and a fastening feature configured to couple with the outer fastener 308, such that the pocket cover 306 covers the edge of the pocket 314 and is partially visible outside of the pocket 314. Such fastening features may be implemented similarly to the fastening features 114*a-d* and the fastening features 116*a-d*. For example, in FIG. 8, the fastening features of the pocket cover 306 are fastening apertures. The portion of the pocket cover 306 visible on the garment 320 may be shaped to form a decorative shape and may include a decorative pattern.

View 324 show a section view of the sleeve adjuster 310, taken along section line 8-8. The sleeve adjuster 310 may be formed of a strip of fabric, a cord, a ribbon, or other elongated member. The sleeve adjuster 310 may include fastening features configured to couple with fasteners inside of the sleeve and outside of the sleeve. In some implementations, the sleeve adjuster 310 may include multiple fastening features such that the sleeve adjuster 310 may be used to adjust the sleeve to different lengths. For example, a fastener 318 is shown on an inner portion of the sleeve and a fastener 312 is shown on an outer portion of the sleeve. In some implementations, additional outer fasteners may be provided on the sleeve such that the sleeve adjuster 310 may be used to adjust the sleeves to various different lengths. The fastening features of the sleeve adjuster 310 may be implemented similarly to the fastening features 114*a-d* and the fastening features 116*a-d*. The fasteners 312 and fastener 318 may be implemented using any type of fastener, including those described with respect to the fasteners 110*a-d* and the fasteners 112*a-d*. The sleeve adjuster 310 may be used by first coupling one fastening feature with the inner fastener 318, and rolling up the sleeve to a desired length. The other fastening feature may then be coupled with the outer fastener 312 to retain the sleeve at the desired length.

The above specification, examples and data provide a complete description of the structure and use of exemplary embodiments of the invention as defined in the claims. Although various embodiments of the claimed invention have been described above with a certain degree of particularity, or with reference to one or more individual embodiment, it is appreciated that numerous alterations to the disclosed embodiments without departing from the spirit or scope of the claimed invention may be possible. Other embodiments are therefore contemplated. It is intended that all matter contained in the above description and shown in the accompanying drawings shall be interpreted as illustrative only of particular embodiments and not limiting.

Changes in detail or structure may be made without departing from the basic elements of the invention and defined in the following claims.

What is claimed is:

1. A system comprising:

a first fastener coupled to a garment in a first location;

a second fastener coupled to the garment in a second location;

a third fastener configured for selective attachment at the first location;

a fourth fastener configured for selective attachment at the second location;

a first connective element comprising a first surface, a second surface opposing the first surface, and at least a first fastening aperture extending from the first surface to the second surface and a first lacing aperture, the first connective element being configured to removably fasten to the garment by at least the first fastener and the third fastener, the first fastener being configured to extend through the first fastening aperture, the first connective element overlaid over an exterior surface of the garment when connected to the garment such that the first surface or the second surface engages the exterior surface of the garment;

a second connective element comprising a third surface, a fourth surface opposing the third surface, and at least a second fastening aperture extending from the third surface to the fourth surface and a second lacing aperture, the second connective element being configured to removably fasten to the garment by at least the second fastener and the fourth fastener, the second fastener being configured to extend through the second fastening aperture, the second connective element overlaid over the exterior surface of the garment when connected to the garment such that the third surface or the fourth surface engages the exterior surface of the garment; and a connector linked to the first connective element and the second connective element such that adjustment of the connector changes a distance between the first location and the second location of the garment and provides a form fitting shape of the garment, wherein the connector is laced through the first lacing aperture and the second lacing aperture of the first and second connective elements.

2. The system of claim 1, wherein the first connective element comprises a plurality of fastening apertures including the first fastening aperture, wherein the first connective element is configured to removably fasten to the garment by a first plurality of fasteners including the first fastener affixed to the garment in the first location and the second connective element comprises a plurality of fastening apertures including the second fastening aperture, wherein the second connective element is configured to removably fasten to the garment by a second plurality of fasteners including the second fastener affixed to the garment in the second location.

3. The system of claim 1, wherein the first connective element and the second connective element comprise flexible material or wherein the first fastener and the second fastener are made from a non-metallic material.

4. The system of claim 1, wherein:

the first connective element comprises a first connection for the connector;

the second connective element comprises a second connection for the connector; and the connector movably couples to the first connection and the second connection.

5. The system of claim 4, wherein the first connection is the first lacing aperture formed in the first connective element and the second connection is the second lacing aperture formed in the second connective element.

6. The system of claim 5, wherein the connector is an elongated flexible component interlaced with the first lacing aperture in the first connective element and the second lacing aperture in the second connective element.

7. The system of claim 1, wherein the first fastener is a button affixed to the garment and extending through the first fastening aperture to removably fasten the first connective element to the garment and the second fastener is a button affixed to the garment and extending through the second fastening aperture to removably fasten the second connective element to the garment.

8. The system of claim 1, further comprising:

a sleeve adjuster comprising a third fastener and a fourth fastener, wherein the third fastener is configured to couple with an inner sleeve fastener on an inner surface of a sleeve of the garment, wherein the fourth fastener is configured to couple with an outer sleeve fastener on an outer surface of the sleeve of the garment.

9. The system of claim 8, wherein each of the outer fastener, the inner fastener, the outer sleeve fastener, and the inner sleeve fastener are non-metallic.

10. The system of claim 1, further comprising a pocket cover comprising a first fastener and a second fastener, wherein the first fastener is configured to couple with an inner fastener on an inner surface of a pocket of the garment, wherein the second fastener is configured to couple with an outer fastener on an outer surface of the pocket of the garment.

11. The system of claim 1, wherein:

each of the first connective element and the second connective element comprises an inner surface; and the inner surfaces touch the exterior surface of the garment when the connective elements are secured to the garment.

* * * * *